US007000677B2

(12) United States Patent
Eberwein

(10) Patent No.: US 7,000,677 B2
(45) Date of Patent: Feb. 21, 2006

(54) ELECTROMAGNETIC BRAKING DEVICE FOR THE INGOT IN A CONTINUOUS CASTING UNIT

(75) Inventor: Klaus-Peter Eberwein, Erkrath (DE)

(73) Assignee: SMS Demag Aktiengesellschaft, Dusseldorf (DE)

( * ) Notice: Subject to any disclaimer, the term of this patent is extended or adjusted under 35 U.S.C. 154(b) by 0 days.

(21) Appl. No.: 10/490,511

(22) PCT Filed: Sep. 7, 2002

(86) PCT No.: PCT/EP02/10029

§ 371 (c)(1),
(2), (4) Date: Mar. 22, 2004

(87) PCT Pub. No.: WO03/028925

PCT Pub. Date: Apr. 10, 2003

(65) Prior Publication Data

US 2004/0244942 A1 Dec. 9, 2004

(30) Foreign Application Priority Data

Sep. 25, 2001 (DE) ..... 101 46 993

(51) Int. Cl.
*B22D 27/02* (2006.01)

(52) U.S. Cl. ..... 164/503; 164/466; 164/504

(58) Field of Classification Search ..... 164/502, 164/503, 504, 466, 468, 498
See application file for complete search history.

(56) References Cited

U.S. PATENT DOCUMENTS 4,256,165 A * 3/1981 von Starck et al. ..... 164/504
4,834,168 A * 5/1989 Nove et al. ..... 164/504
4,957,156 A 9/1990 Mayrhofer
5,727,615 A * 3/1998 Middeldorf et al. ..... 164/502

* cited by examiner

*Primary Examiner*—Len Tran
(74) *Attorney, Agent, or Firm*—Herbert Dubno

(57) ABSTRACT

The invention relates to an electromagnetic braking device for the steel melt running within the continuous casting ingot in a continuous casting unit. The electromagnetic brake device comprises at least one coil (3) with a ferromagnetic core (5), arranged on the broad side of the ingot and at least one yoke (7) provided on the above. In order to reduce the oscillating masses on the ingot components and to permit the retro-fitting of electromagnetic brakes to conventional continuous casting machines, the electromagnetic brake, comprising yoke (7), coil (3) and ferromagnetic core (5), is embodied such as to pivot inwards or outwards, preferably by means of two unequal length, non-parallel levers in or on the continuous casting ingot, using an actuator (6).

7 Claims, 2 Drawing Sheets

ELECTROMAGNETIC BRAKING DEVICE FOR THE INGOT IN A CONTINUOUS CASTING UNIT

CROSS REFERENCE TO RELATED APPLICATIONS

This application is a national stage of PCT/EP02/10029 filed 7 Sep. 2002 and based upon German national application 101 46 993.4 filed 25 Sep. 2001 under the International Convention.

FIELD OF THE INVENTION

The invention relates to an electromagnetic braking device for the steel melt which flows into the continuous casting mold of a continuous casting apparatus and which comprises at least one coil juxtaposed with a broad side of the mold and having a ferromagnetic core and at least one yoke juxtaposed or associated with the latter.

BACKGROUND OF THE INVENTION

Continuous casting plants of the type described at the outset are known. The casting stream flowing into the mold is braked by a magnetic field which is caused to be effective between the broad sides of the continuous casting mold to reduce the turbulence and to direct, orient or smooth out the casting stream. To generate the magnetic field, ferromagnetic cores are applied against the copper plates of the broad sides and coils surrounding the cores are electrically excited. Directing effects of the magnetic field upon the casting stream has the effect of calming the steel bath and reducing the turbulence within the steel bath with the goal of ensuring a uniform casting of the steel strand.

In the state of the art, an integrated arrangement of the magnetic braking device is known, whereby the ferromagnetic coil and the coil through which the electric current flows are fixed on the mold. Depending upon the configurations of these components of the braking device, the latter may have considerable weight which must be supported by the lifting table of the mold and thus must be moved together therewith. It is a drawback of an integrated arrangement of the braking device and the mold that the masses which must be oscillated with mold oscillation can be excessively high and, further, that the integrated arrangement contributes to increased changeover times for the coupling of water and electrical connections to the assembly and the disconnection of those connections. In addition, the electromagnetic braking device can impede the requisite heat dissipation from the copper plates. Finally a relatively large number of electromagnetic brakes must be provided each mold in this configuration.

In the state of the art an external arrangement of an electromagnetic brake is also known in which the electromagnetic coil and the core through which the electric current flows are arranged to be movable in the apparatus. With the external arrangement of the coil and core, the masses which have to be oscillated are thereby reduced. The changeover time can be significantly reduced since the need for connecting and disconnecting water and electrical fittings is eliminated. Finally this system requires only a small number of electromagnetic brake units, namely only a single electromagnetic brake per casting strand.

DE 198 07 842 A1 describes a continuous casting plant with an electromagnetic braking device which is comprised of at least one coil juxtaposed with a broad side of a casting mold with a ferromagnetic coil and at least one yoke juxtaposed therewith. At least some individual parts of the electromagnetic braking device are supporting members for the continuous casting mold. The magnetic field generated by the electromagnetic braking device is distributed with reference to the continuous casting mold into at least one upper magnetic field and a lower magnetic field. At least the inner ones of the electromagnetic cores form at the same time cooling chambers by means of which cooling water can be supplied and the cooling water can be discharged. Through the integration of the electromagnetic braking device as supporting components in the continuous casting mold, indeed there is a saving in weight, but nevertheless the mass which must be oscillated is relatively high.

OBJECT OF THE INVENTION

The object of the invention is to improve upon the aforedescribed arrangements of electromagnetic brakes on continuous casting molds and especially to avoid the tendency of tilting resulting from an axial feed through a slide or carriage guide arrangement which, in addition, requires sufficient place and contributes additional weight, and whereby the retrofitting of an existing continuous casting apparatus with the improved electromagnetic brake is facilitated or simplified.

SUMMARY OF THE INVENTION

The object achieved with an electromagnetic brake comprised of the yoke, the coil which can be traversed by an electric current and the ferromagnetic core, and which is swingable in or on the continuous casting mold by at least one positioning unit into and out of position. Preferably the mechanical swinging of the brake into position and out of position is effected by means of at least two nonparallel levers of unequal length. As a result, in spite of the provision of a rail carrier for the tundish carriage, the prerequisites for an optimal retrofitting of continuous casting plants with the brake device according to the invention are satisfied.

In a refinement of the electromagnetic brake according to the invention the brake comprised of the yoke, the electric-current-traversed core and the ferromagnetic core are not oscillatable together with the continuous casting mold.

With the features according to the invention the advantage can be obtained that the electromagnetic brake independently of the continuous casting mold is readily replaceable and that the oscillating masses on components of the continuous casting mold remain limited and no additional mass must be oscillated because of the components of the electromagnetic brake.

According to another feature of the electromechanical brake according to the invention, it is proposed to provide a magnetic partial core to reduce the pole spacing and to increase the effectivity of the electromagnetic brake in magnetic water boxes.

BRIEF DESCRIPTION OF THE DRAWING

The invention is described in conjunction with an embodiment thereof further below, from which additional details and advantages of the invention can be deduced. In the drawing.

SPECIFIC DESCRIPTION

Figure 1:
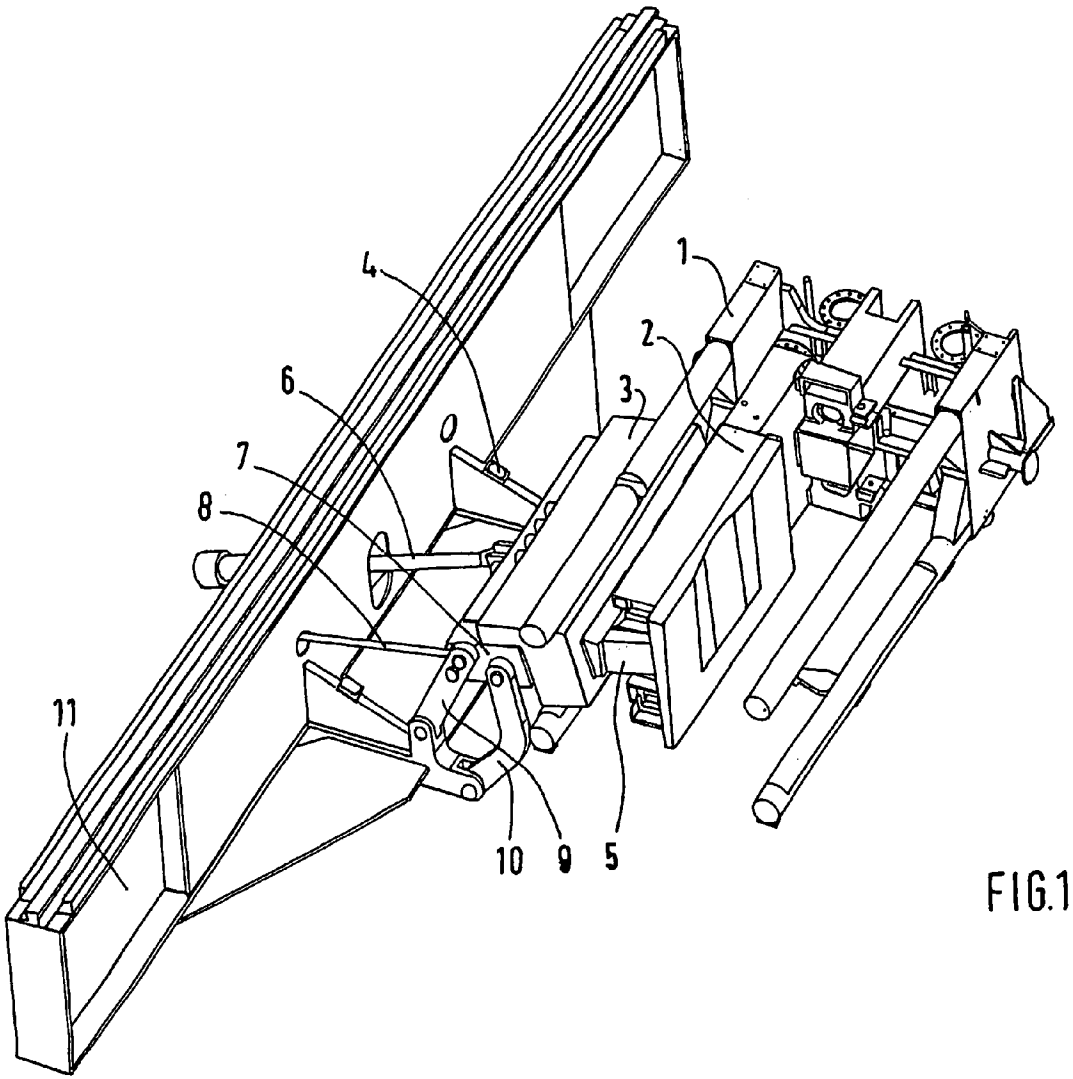
FIG. 1 is a perspective view showing the working position of the electromagnetic brake.
Figure 2:
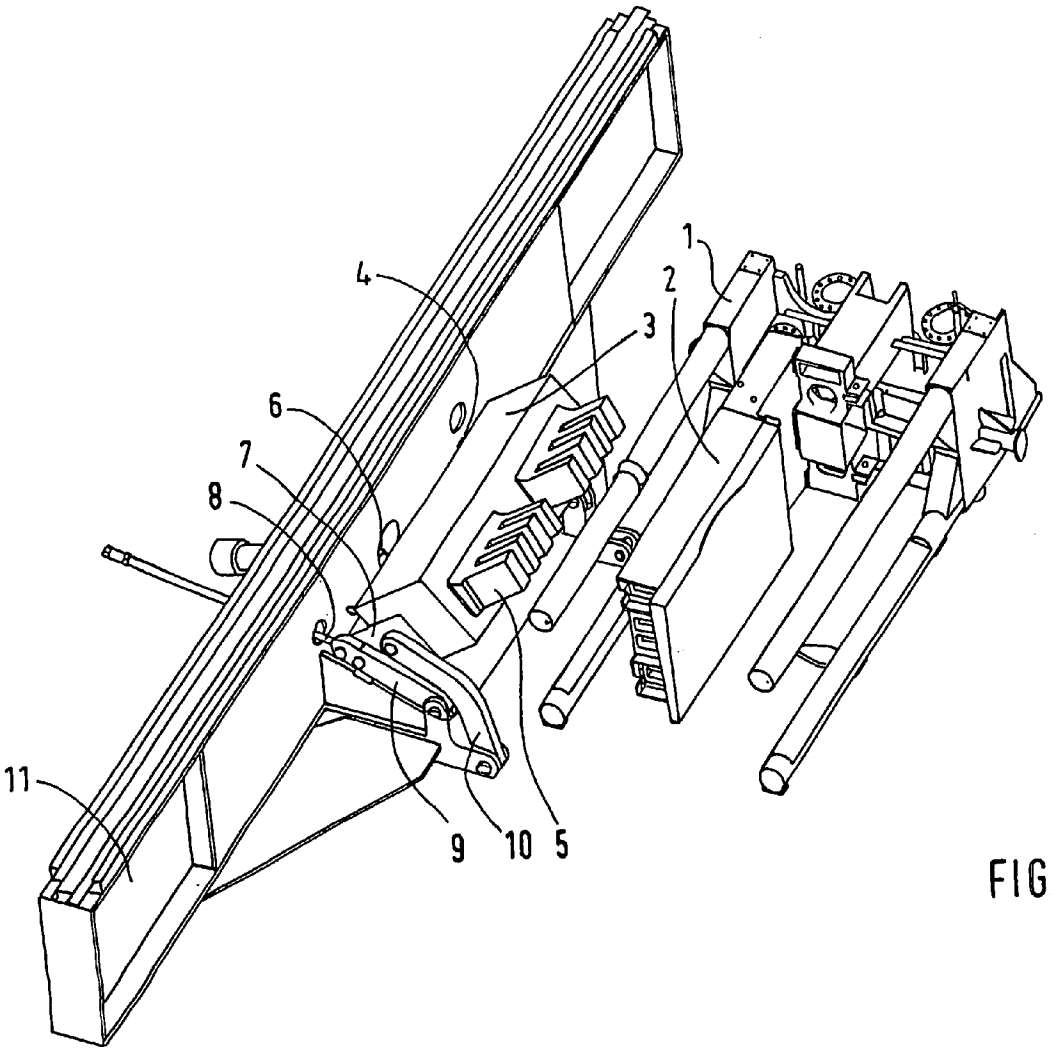
FIG. 2 is a perspective view showing the rest position of the electromagnetic brake.

FIGS. 1 and 2 show the electromagnetic brake according to the invention comprised of a yoke 7, a coil 3 which is traversed by an electric current and a ferromagnetic core 5. The electromagnetic brake is affixed by means of a mechanism having two pairs of unequal length, nonparallel levers 9, 10 on a rail carrier 11 and is displaceable by a positioning element 6, for example a hydraulic cylinder, articulated to the center thereof. On the one hand this enables a displacement of the electromagnetic brake along a curve but with an approximately horizontal movement thereof out of the water box 2 and the frame 1 of the mold 2. On the other hand it ensures a space-saving rest position for the electromagnetic brake between the rail carrier 11 and the mold so that the replacement of the mold and the strand guide segments of the continuous casting apparatus is possible in a problem-free manner. This arrangement also ensures a small stroke as well as a smaller adjustment force than does a linear system for displacement of the electromagnetic brake since the system is located close to its upper dead point. The continuous casting molds and the electromagnetic brake are independent components so that in calculating the oscillating forces, exclusively the mass to be moved of the mold components need be considered. FIG. 1 shows the electromagnetic brake in the working position. In the working position there is an adjustable stroke limiter 8 establishing the position. FIG. 2 shows the rest position of the electromagnetic brake. In the rest position the brake lies against the abutments 4.

What is claimed:

1. An electromagnetic brake device for a steel melt flowing into a continuous casting mold of a continuous casting apparatus, the electromagnetic brake device comprising:

at least one coil juxtaposable with a broad side of the mold; a ferromagnetic core for the coil;

at least one yoke (7) juxtaposed with the coil a mechanism having two unequal length nonparallel levers for swinging the yoke, coil and ferromagnetic core, into position or out of position in or on the continuous casting mold and at least one positioning element for displacing said mechanism.

2. The electromagnetic brake device according to claim 1 which is not oscillatable together with the continuous casting mold.

3. The electromagnetic brake device according to claim 1 which has a working position established by a mechanical stroke limiter on the continuous casting mold.

4. The electromagnetic brake device according to claim 1, wherein, for reducing a pole spacing and increasing effectivity of the electromagnetic brake device in magnetic water boxes, a magnetic partial core is provided.

5. The electromagnetic brake device according to claim 1 wherein the positioning element is formed by at least one hydraulic cylinder.

6. The electromagnetic brake device according to claim 1 wherein a working position of the electromagnetic brake device is determined by at least one adjustable stroke limiter.

7. The electromagnetic brake device according to claim 1 wherein said mechanism has a rest position determined by at least one abutment 4.

* * * * *